United States Patent [19]

Oishi

[11] Patent Number: 4,485,535

[45] Date of Patent: Dec. 4, 1984

[54] METHODS OF MANUFACTURING PILE FABRIC

[75] Inventor: Takashi Oishi, Ohtsu, Japan

[73] Assignee: Toray Industries, Inc., Tokyo, Japan

[21] Appl. No.: 348,148

[22] Filed: Feb. 11, 1982

Related U.S. Application Data

[62] Division of Ser. No. 144,858, Apr. 29, 1980, abandoned.

[30] Foreign Application Priority Data

May 4, 1979 [JP] Japan ..... 54-54026

[51] Int. Cl.[3] ..... D06C 11/00; D06C 27/00

[52] U.S. Cl. ..... 28/162; 28/168

[58] Field of Search ..... 8/114.6; 28/162, 168, 28/142; 139/383 A; 26/69 B

[56] References Cited

U.S. PATENT DOCUMENTS

| | | | |
|---|---|---|---|
| 1,021,712 | 3/1912 | Wilkinson | 28/168 |
| 2,575,008 | 11/1951 | Dorgin | 28/168 X |
| 2,821,771 | 2/1958 | Skeer | 28/142 |
| 2,825,958 | 3/1958 | Chandler | 28/162 |
| 3,075,274 | 1/1963 | Mizell | 139/383 A X |
| 3,114,191 | 12/1963 | Chapin | 28/162 |
| 3,302,265 | 2/1967 | Davis et al. | 28/162 X |
| 3,403,433 | 10/1968 | Schoeneberg | 28/162 |
| 4,118,529 | 10/1978 | Nakagawa | 428/259 |
| 4,352,705 | 10/1982 | Ozaki et al. | 428/91 X |

FOREIGN PATENT DOCUMENTS

| | | | |
|---|---|---|---|
| 894509 | 3/1972 | Canada | 28/162 |
| 52-49395 | 4/1977 | Japan | 8/114.6 |

*Primary Examiner*—Robert Mackey

*Attorney, Agent, or Firm*—Austin R. Miller

[57] ABSTRACT

A method of manufacturing a cashmere or vicuna-like fabric with a distinctive handle having more than 80 percent voids. A fabric is woven of warp yarns of synthetic fibers selected from polyester and polyamide fibers and crimped fibers which are readily soluble, and weft spun yarns of synthetic fibers selected from polyester and polyamide fibers of 0.4 to 1.4 denier or weft blended spun yarns of a blend of at least 70 wt. pct. of synthetic fibers of 0.4 to 1.4 denier selected from polyester and polyamide fibers and crimped fibers which are readily soluble. The nap on the fabric is raised and then the readily-soluble fibers are dissolved and substantially removed to form more than 80 percent voids in the fabric as calculated by the formula $$E = \frac{S - \frac{W}{1000 \times T}}{S} \times 100$$

wherein E is the percentage of voids in the fabric structure, W is the weight of the fabric in grams per square meter, T is the thickness of the fabric in millimeters and S is the specific gravity of the fibers in grams per cubic centimeter.

6 Claims, 1 Drawing Figure

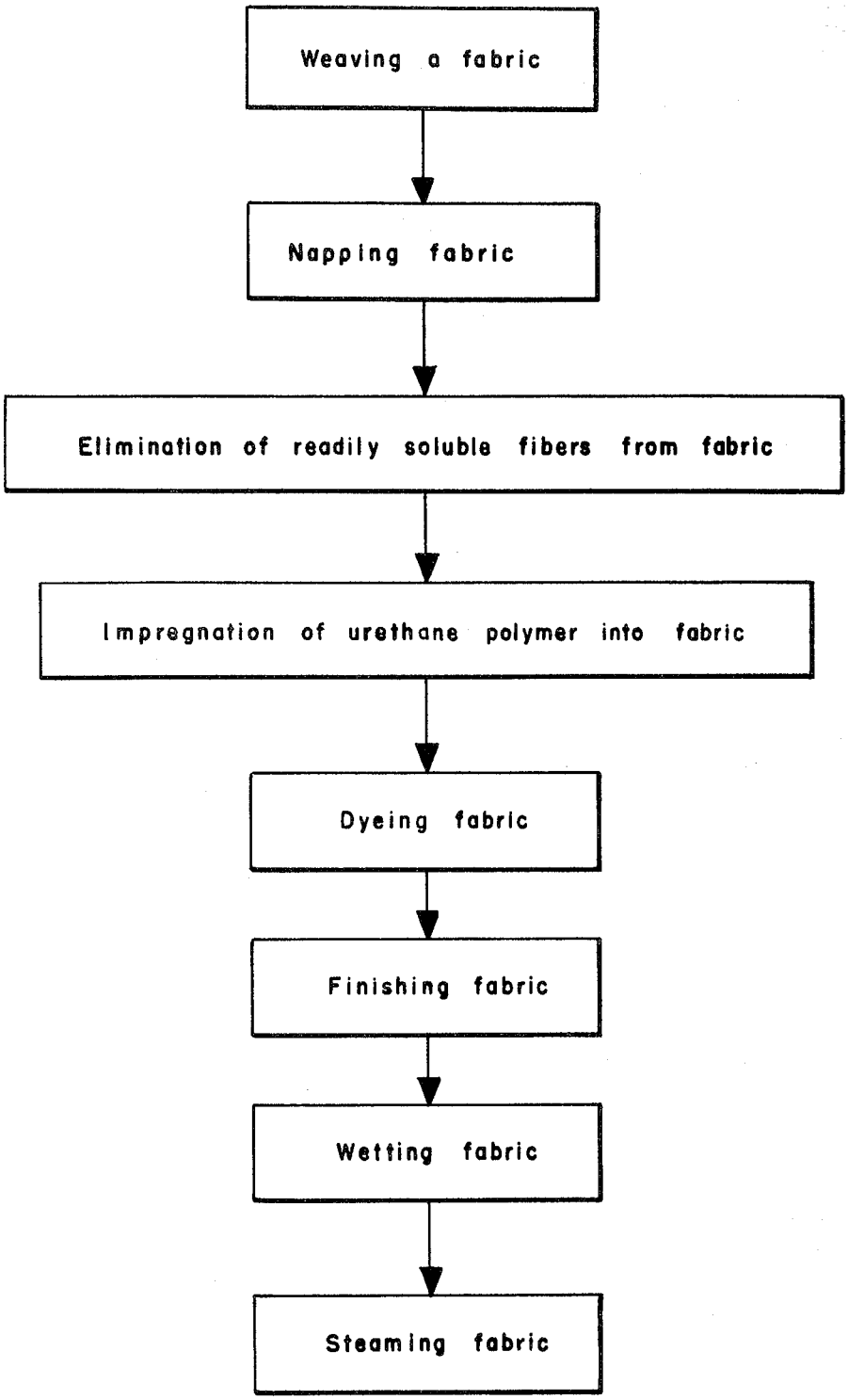
Weaving a fabric
Napping fabric
Elimination of readily soluble fibers from fabric
Impregnation of urethane polymer into fabric
Dyeing fabric
Finishing fabric
Wetting fabric
Steaming fabric

METHODS OF MANUFACTURING PILE FABRIC

This is a division of application Ser. No. 144,858 filed Apr. 29, 1980, now abandoned.

BACKGROUND OF THE INVENTION

The present invention relates to a woven fabric having a distinctive handle and the manufacturing method thereof, and, more particularly, to a novel synthetic fiber, nap-raised woven fabric which, in spite of its being constituted of synthetic fibers, has a handle like that of high-class natural wool fabrics, such as cashmere and vicuna.

DESCRIPTION OF THE PRIOR ART

A great variety of nap-raised woven fabrics, using synthetic fibers, has been developed, produced and sold for several years. All these hitherto known napped fabrics have, however, both merits and demerits.

For example, those which have been processed with an aim to obtaining a suede-like effect somehow give a feeling that they are "hard at the core". That is, they are soft on the surface but are coarse in other respects of the handle; or their weight per unit area is exceedingly great; or they are of a "flattened" structure. In effect, they have a very small amount of voids in the fabric structure in all instances.

Further, there are many kinds of 100-pct. synthetic fiber napped fabrics which have been processed to a finished product resembling natural wool fabrics, such as disclosed in U.S. Pat. No. 4,118,529, but, there again, they often feel coarse on the surface; or give a feeling that they are somehow "hard at the core", for they have a very small amount of voids in the fabric structure; or, although they are thick enough, their weight per unit area is too great for the same reason.

Still further, there have hitherto been produced fabrics, by the name of "wool-like synthetic fiber textiles" that are composed of the so-called "bimetal type" composite fibers, or the "core-sheath type" composite fibers, or of synthetic fibers which have been imparted with an anti-pilling property by reducing their resistance to flexural abrasion; but, in this instance, too, there is a very small amount of voids in their fabric structure and therefore they somehow give a feeling that they are "hard at the core".

Thus, a really nice handle which natural wool fabrics possess has not so far been obtained with textiles which are constituted of synthetic fibers.

SUMMARY OF THE INVENTION

It is the object of the present invention to provide, in the light of such shortcomings as were described in the foregoing of the hitherto-known products, a novel 100-pct. synthetic fiber, soft-touch fabric having a distinctive handle, and a method for its preparation.

A fabric according to the present invention is manufactured through processes which are different from those of the conventional manufacturing methods where synthetic fiber yarns are simply woven into a fabric to form a finished product. In accordance with the present invention, it becomes possible to obtain a synthetic fiber fabric having a handle which compares favorably with that of high-class natural wool textiles like cashmere and vicuna.

The foregoing object is accomplished by means of a fabric having a structure as will be described hereunder and a specific method for producing same.

That is, the fabric of the present invention is a nap-raised textile having a distinctive handle, which is characterized by the fact that it has more than 80 pct. voids in the fabric structure, that its fluff on the surface is composed of synthetic fiber staples of 0.4 to 1.4 deniers and it is composed of at least one kind of synthetic fiber selected from the group consisting of polyester and polyamide.

Further, the method of manufacturing the fabric with a distinctive handle according to the present invention is characterized by the fact that it consists in: for the warp, yarns consisting of a blend of synthetic fibers made of at least one kind of synthetic fiber selected from the group consisting of polyester and polyamide and easily-soluble fibers having crimps; for the weft, spun yarns consisting of 100 pct. synthetic fibers, of 0.4 to 1.4 deniers, made of at least one kind of synthetic fiber selected from the group consisting of polyester and polyamide, or blended spun yarns consisting of a blend of at least 70 wt. pct. of synthetic fibers made of at least one kind of synthetic fiber selected from the group consisting of polyester and polyamide, of 0.4 to 1.4 deniers, and easily-soluble fibers having crimps, from these warp and weft yarns is woven a fabric, which is then napped; and the aforesaid easily-soluble fibers having crimps are almost entirely removed by dissolving them.

BRIEF DESCRIPTION OF THE DRAWING

The single FIGURE of the drawing represents a flow chart of the processing steps utilized in achieving fabric characteristics desired in the preferred embodiments of the invention.

DETAILED DESCRIPTION OF PREFERRED EMBODIMENTS

The fabric of the present invention, with a distinctive handle, is napped on its surface or surfaces, and the fluff on the surface is constituted of synthetic fiber staples, of 0.4 to 1.4 deniers, made of at least one kind of synthetic fiber selected from the group consisting of polyester and polyamide, etc. These synthetic fiber staples may either be a single kind of synthetic fibers or be composed of two or more kinds of synthetic fibers.

The outstanding characteristics of the fabric of this invention, with a distinctive handle, lies in that the percentage of voids in the fabric structure comprises a value of more than 80 pct. According to what the inventor has been able to find out, the percentage of voids in the fabric structure with hitherto-known, similar fabrics made of synthetic fibers, as were previously mentioned, are generally about 25 pct., at the very most, 30 to 50 pct. As such, an exceedingly large percentage of voids in the fabric structure in the present invention, as above, is quite novel and constitutes a predominant characteristic. A fabric wherein the percentage of voids in the fabric structure is smaller than 80 pct. is lacking in soft touch and pliability, or feels heavy; which is, of course, undesirable since it is well nigh impossible to accomplish the object of the present invention.

Here, the "percentage of void in the fabric structure" is defined as follows.

That is, it is a value which will be obtained by using the following formulas, as laid down in JIS L 1079.

The apparent specific gravity "G" of a fabric (g/cm$^3$) is obtained by this:

$$G = \frac{W}{1000 \times T}$$

wherein

"W" is the weight of a fabric (g/m$^2$) in its standard state, and

"T" is the thickness of the fabric (mm);

and from this value, the percentage of voids in the fabric structure "E" is obtained by:

$$E = \frac{S - G}{S} \times 100\ (\%)$$

wherein

"S" is the specific gravity of the fibers (g/cm$^3$).

By virtue of the existence of the fluff on the surface which is constituted of synthetic fibers of 0.4 to 1.4 deniers, and of the largeness of the percentage of voids in the fabric structure, as were described in the foregoing paragraphs, the present invention successfully provides a synthetic fiber fabric having a distinctive handle, giving an impression of a very high class material which could not possibly be obtained by conventional techniques.

When the fluff on the surface is constituted of synthetic fibers in a fineness smaller than 0.4 denier, the product will have a handle like that of a suede-fabric; so that is not desirable. When, on the other hand, naps are in a fineness larger than 1.4 deniers, the product will have a coarse handle, that is, it will feel rough and so such is also undesirable.

The synthetic fiber fabric of the present inventor, which has a special structure as previously mentioned, can be manufactured rationally and effectively only by a manufacturing processes as will be described in the following paragraphs.

That is, in the first place, a fabric is woven using the following yarns, viz.: for the warp, yarns consisting of a blend of synthetic fibers made of at least one kind of synthetic fiber selected from the group consisting of polyester and polyamide and fibers which are soluble with chemicals, etc., relatively with ease and which, besides, have crimps, such as wool, etc.; and for the weft, spun yarns consisting of 100 pct. synthetic fibers, in 0.4 to 1.4 deniers, made of at least one kind of synthetic fiber selected from the group consisting of polyester and polyamide, in 0.4 to 1.4 deniers, and readily-soluble fibers having crimps.

As for the aforesaid readily-soluble fiber, it is not limited to a specific material. Either wool, as mentioned above, or cotton, rayon, water-soluble vinylon, etc., may be brought into employment. As far as the inventor has been able to find out, however, the best effect is obtained when wool is used for this purpose, producing the fabric with a distinctive handle according to this invention in the most desirable form.

Such readily-soluble fibers as used in this invention are required to have crimps, and the average number of crimps is preferably to be 16 per in. or more. Wool with such an average number of crimps is the most desirable. Further, there is a preference in the selection of the number of crimps of such readily-soluble fibers also from the viewpoint of its correlation with that of the other kind of fibers—synthetic fibers—with which the readily-soluble fibers are blended. To put it in concrete terms, it is preferable to be so composed that the average number of crimps of the readily-soluble fibers will be larger than that of the synthetic fibers with which they are blended. It is desirable that the average number of crimps of the readily-soluble fibers is larger by one crimp or more per inch. When the correlation in the average number of crimps is made to be like this, the percentage of void in the fabric structure after removal of the readily-soluble fibers by dissolving them, as will be described later in this specification, will be infallibly large.

Of the yarns used as the warp in the method of this invention, the amount of such readily-soluble fibers blended is preferably to be in the range of 10 to 40 pct. by weight. As for the synthetic fibers used for the warp yarns, they may be either continuous filaments or staples, and crimp-processed. In the case of staples, however, those wherein the fiber length is within the range of 64 to 150 mm are preferable. While no restriction is placed on the fineness of synthetic fibers used as a component of the warp yarns, those in the range of 1.5 to 5 deniers are preferable. When synthetic fibers outside such range of deniers are used, the fabrics obtained are often lacking in resilience, or have, in general, a coarse handle and so such are not desirable.

Yarns for use as the warp may be either in the form of textured yarns composed of continuous filaments or in the form of spun yarns; but, wool is the most desirable as the readily-soluble fiber, as was previously stated. The best effect will be obtained with blended spun yarns in which wool is used as one of the components.

It is necessary that the synthetic fibers utilized as one of the constituents of the weft yarn be made of at least one kind of synthetic fiber selected from the group consisting of polyester and polyamide, etc., and have a fineness in the range of 0.4 to 1.4 deniers. It further is desirable that their fiber length be in the range of 32 to 76 mm. In the fabric of the present invention, mainly these synthetic fibers, of 0.4 to 1.4 deniers, of the weft yarns are raised by the napping process and constitute the fluff on the surface. The amount of these synthetic fibers, of 0.4 to 1.4 deniers, contained in the weft yarn preferably accounts for at least 70 pct. by weight, as was previously stated; and, also in the case of the warp yarns, readily-soluble fibers may be used for the rest. As for spun yarns for the weft, the effect of the present invention is achieved to the greatest extent when those manufactured by the woolen spinning system are employed.

In the method of the present invention, a fabric is composed of the warp and weft as described in the foregoing paragraphs; and the loom for use may be either the shuttle loom or the so-called "innovated loom".

To attain the desired object of the present invention, it is also important to make the fabric structure to be that which is the most suitable. In this respect, the double faced 5/5 satin weave, double faced 2/2 twill weave, double faced 3/2 twill weave, etc., are preferable; in particular, the double-faced duplex 5/5 satin weave is preferable for thicker materials, and the 2/2 twill weave for thinner materials. Further, it is desirable that the fabric has the same fabric structure on both sides.

It is desirable that the content of readily-soluble fibers be in the range of 5 to 55 pct. of the total weight of the fabric. After having scoured the fabric, an adequate amount of oil napping aid is added to it; then it is dried and supplied to the nap-raising process. Napping is preferably to be applied to both sides of the fabric.

The nap-raising process is not limited to a specific method, but may be carried out, on a wire cloth napping machine, etc., by any system desired, for instance, the French, German, British, American, universal, or oil hydraulic system. When napping is applied on both sides of the fabric in such nap-raising process, it is desirable to provide such a device that napping is greater on the surface which is supposed to be the right side of the fabric as a finished product than on the other side, or the torque of the napping roller is made larger for such surface than for the other side, so that such surface may have a denser fluff.

In the method of the present invention, from the fabric which has undergone the napping process as above, the readily-soluble fibers contained in it are removed by dissolution, by an appropriate means that fits the nature of such fibers.

For example, when wool has been used as the readily-soluble fibers, the following methods may be employed to advantage. That is, the fabric may be treated by boiling for about 20 minutes in an aqueous solution of an alkali at an adequate concentration, for example, 1 to 3-pct. NaOH solution; or it may be treated in an alkali solution of a proper concentration at a low temperature for many hours. By subjecting the fabric to such a treatment, the wool is almost totally dissolved and removed, and substantially no dissolution of the synthetic fiber constituent of the fabric takes place.

In this way, a fabric of the present invention with a distinctive handle, having an exceedingly large percentage of voids in the fabric structure, is obtained; and such fabric is further processed to a finished product with such percentage of voids in the fabric structure maintained at as high level as possible through all processes it undergoes.

Although several kinds of readily-soluble fibers, such as wool, cotton, rayon, water-soluble vinylon, etc., may be employed in the present invention, it appears that the best effect is obtained through their removal by dissolution when wool is used, as was previously stated. This is because, it is thought, other kinds of fibers are, in general, not possessed of such "three-dimensional" structure of crimps nor of a desirable number of crimps. That is, if, as the readily-soluble fiber of this invention, those which are possessed of a three-dimensional structure of crimps and a large number of crimps are used, a fabric with a higher percentage of voids in the fabric structure is obtained when the readily-soluble fibers are removed by dissolution. The reason why it is desirable to make the average number of crimps of the readily-soluble fibers contained in the warp yarns larger than that of the synthetic fibers blended with them lies also in this point; that is, to ensure attainment of as high a percentage of voids as possible in the fabric structure after removal of the readily-soluble fibers by dissolution.

In the method of the present invention, fabric is dyed after removal of the readily-soluble fibers.

When it is desired, in particular, to stabilize the nap, the fabric of the present invention may be impregnated with an adequate amount of an elastic elastomer, for example, polyurethane. Such impregnation may be carried out either before of after dyeing the fabric; and the amount of the elastic high polymer is preferably in the range of 3 to 15 wt. pct.

As the finishing process, naps which are too long, in the fabric, may be cut by means of buffing (a roller sander or a belt sander may be used to advantage), or may be sheared off by the use of a shearing machine.

For the final finish of the fabric with a distinctive handle according to the present invention, it is possible to apply the same process as in finishing woolens and worsteds which have hitherto been in practice.

According to the present invention which has been described in detail in the foregoing paragraphs, it is possible to obtain a synthetic fiber fabric which possesses a novel and high-class handle, exceedingly light and soft, and which could not possibly be obtained with synthetic fiber fabrics according to conventional techniques. Additionally, as a synthetic fiber for use in this invention, polyester seems to be the best suited.

The fabric according to the present invention is ideal for overcoating, etc.

Hereunder are given a few examples of the embodiment of the present invention by way of explaining it further in concrete terms.

EXAMPLE 1

Using, for the warp, spun yarns in 60/2 consisting of a blend of 64 wt.pct. polyester staples in 3 deniers, having a fiber length of 89 mm, and 36 wt.pct. of wool, Quality No. 64S, and, for the weft, spun yarns in 24/2 composed of 100 percent of polyester staples in 1.3 deniers, having a fiber length of 64 mm, a fabric was woven in 2/2 twill weave; and was napped on both sides.

The fabric was treated by boiling it for 20 minutes in an aqueous solution of alkali (2.5% of NaOH solution), and the wool contained in the warp yarns was completely removed by dissolution.

Subsequently, the fabric was dyed; its width was set by tentering; and the length of naps was made uniform by the use of a shearing machine; and thus a fabric in accordance with the present invention was obtained.

The percentage of voids in the fabric structure "E", as defined in the text, was 89 pct. ($W=265$ g/m$^2$, $T=1.89$ mm, $G=0.1402$ g/cm$^3$, and $S=1.38$ g/cm$^3$) with this fabric obtained; and the fabric showed a high-class handle which was not seen with conventional products.

The fabric was further processed, viz.: it was impregnated with 10 wt.pct. of polyurethane; dried; and then finished by passing it through a roller brush. The resultant product had stabilized naps, was light in weight, and had an exceedingly high-class handle like that of cashmere, being ideal for overcoating.

For the purpose of comparison, a fabric was made by an ordinary manufacturing method using yarns consisting 100 percent of polyester fibers in 1.0 denier, woven in the same manner as above, but napped on one side only. The percentage of voids in the fabric structure with this product was 38 pct.; and although the fabric had a soft touch just on the surface, it somehow felt hard at the "core", the handle being rather coarse on the whole.

EXAMPLE 2

Using for the warp, spun yarns in 60/2 consisting of a blend of 70 wt.pct. polyester staples of 2.5 deniers, having a fiber length of 64 mm and an average number of crimps of 12 per inch, and 30 wt.pct. of wool having an average number of crimps of 18 per inch, and, for the weft, spun yarns in 24/2 composed of 100 persent of polyester staples in 1.0 denier, having a fiber length of 44 mm and an average number of crimps of 13 per inch, a fabric was woven in 2/2 twill weave; and it was napped on both sides. This fabric was treated by boiling it for 20 minutes in the same alkali solution as that used in Example 1, and the wool contained in it was completely removed by dissolution.

Subsequently, the fabric was dyed; its width was set by tentering; and the length of naps was made uniform by means of a shearing machine; and thus a fabric in accordance with the present invention was obtained.

The percentage of voids in the fabric structure, as defined in the text, was 83 pct. and the fabric showed a handle like that of high-class woolen textiles which could not be seen with synthetic fiber fabrics heretofore produced.

The fabric was further subjected to these processes, viz.: it was impregnated with 10 wt.pct. of polyurethane; dried; and was then finished by passing it through a roller brush. The resultant product had stabilized naps and was richer in handle like that of high-class woolen textiles.

This fabric was very soft in touch and was light in weight, resembling cashmere and exceedingly good for overcoating.

What I claim is:

1. Method of manufacturing a fabric having a distinctive cashmere- or vicuna-like hand, comprising:

(1) weaving warp and weft yarns into a fabric, (A) said warp yarns comprising a spun blend of (i) 60–90% by weight of a synthetic staple fiber and (ii) 10–40% by weight of a crimped staple fiber which is readily soluble in a selective solvent which does not substantially dissolve the synthetic staple fiber (i), (B) said weft yarn being a synthetic spun yarn of 0.4–1.4 denier, (2) raising the nap on said fabric, (3) substantially removing the crimped fibers (ii) by dissolving them in said solvent, thereby forming more than 80% voids in said fabric as calculated by the formula $$E = \frac{S - \frac{W}{1000 \times T}}{S} \times 100$$

wherein E is the percentage of voids in the fabric structure, W is the weight of the fabric in grams per square meter, T is the thickness of the fabric in millimeters and S is the specific gravity of the fibers in grams per cubic centimeter.

2. The method defined in claim 1 wherein the weft yarn contains up to 30% by weight of crimped fibers which are readily soluble in said selective solvent.

3. The method defined in claim 1, wherein the weft yarn has polyester fibers.

4. The method defined in claim 3, wherein the weft yarn is a blended spun yarn of at least 70% by weight of the polyester fibers.

5. The method defined in claim 1, wherein the weft yarn has polyamide fibers.

6. The method defined in claim 5, wherein the weft yarn is a blended spun yarn of at least 70% by weight of the polyamide fibers.

* * * * *